US005131242A

United States Patent [19]

Ager

[11] Patent Number: 5,131,242

[45] Date of Patent: Jul. 21, 1992

[54] CLOSED LOOP REFRIGERANT RECOVERY SYSTEM

[76] Inventor: Frederick L. Ager, 9119 #2 Cy. 887, Manuel, Tex. 77578

[21] Appl. No.: 616,834

[22] Filed: Nov. 21, 1990

[51] Int. Cl.[5] ..... F25B 43/04

[52] U.S. Cl. ..... 62/475

[58] Field of Search ..... 62/85, 475

[56] References Cited

U.S. PATENT DOCUMENTS

| | | | |
|---|---|---|---|
| 2,321,964 | 6/1943 | Zieber | 62/475 X |
| 2,400,620 | 5/1946 | Zwickl | 62/85 |
| 2,464,631 | 3/1949 | Zwickl | 62/475 |
| 2,986,905 | 6/1961 | Kocher et al. | 62/475 |
| 3,013,404 | 12/1961 | Endress et al | 62/475 X |
| 3,145,544 | 8/1964 | Weller | 62/475 X |
| 3,276,216 | 10/1966 | Papapanu | 62/85 |
| 5,005,369 | 4/1991 | Manz | 62/475 X |

*Primary Examiner*—William E. Tapolcai
*Attorney, Agent, or Firm*—Nelson A. Blish

[57] ABSTRACT

A closed loop refrigerant recovery system (10) having a primary purge condenser (20) and a secondary purge condenser (30 ). Non-condensible gas and refrigerant vapor is vented from condenser (8) to primary purge condenser (20). Non-condensible gas still containing refrigerant vapor is compressed by purge conpressor (50) and conducted to secondary purge condenser (30). The temperature of secondary purge condenser (30) is maintained low enough so that when relief valve (36) lifts, there will be no refrigerant vapor contained in the gas released.

6 Claims, 1 Drawing Sheet

CLOSED LOOP REFRIGERANT RECOVERY SYSTEM

BACKGROUND OF THE INVENTION

This invention relates in general to air conditioning systems and in particular for a system for recovering Freon from non-condensible gases.

In air conditioning systems Freon, a liquid fluorinated hydrocarbon, or a similar refrigerant, is used as a cooling medium. The Freon is expanded to absorb heat from the interior of a building or factory and is condensed or compressed to extract the heat at another location, usually outside the building. It is not uncommon for air and other non-condensible gases to enter the refrigeration cycle at some point. The non-condensible gases collect in the condenser and interfere with the proper operation of the cooling system and must be removed.

In the past, it has been common practice to vent the non-condensible gases to atmosphere. However, the non-condensible gases contain some Freon vapor which is an atmospheric pollutant and may be subject to Environmental Protection Agency (EPA) regulations. Also, in commercial or industrial applications, the amount of Freon vapor vented to the atmosphere results in an unnecessary expense, sometimes a large expense since the Freon lost to atmosphere must be recharged back to the system.

Prior attempts to recover the Freon vented to the atmosphere or separated from the non-condensible gases have not met with great success. One method commonly practiced has been to use the refrigerant from the air conditioning unit to circulate through a purge condenser to condense out the Freon vapor from the non-condensibles. This has met with some problems since the refrigerant temperature fluctuates depending on the load of the air conditioning unit and ambient temperature. Thus the non-condensibles released from the purge condenser still contain some Freon vapor.

SUMMARY OF THE INVENTION

The present invention uses a secondary purge condenser to condense out essentially all Freon or refrigerant vapors from the non-condensibles vented from a primary purge condenser. A purge compressor, independent of the primary system, operates at a constant condensing temperature less than the boiling point of Freon or other refrigerant used. A secondary or reciprocating chiller is used in one embodiment to condense Freon in the secondary condenser.

DETAILED DESCRIPTION OF THE DRAWINGS

Figure 1:
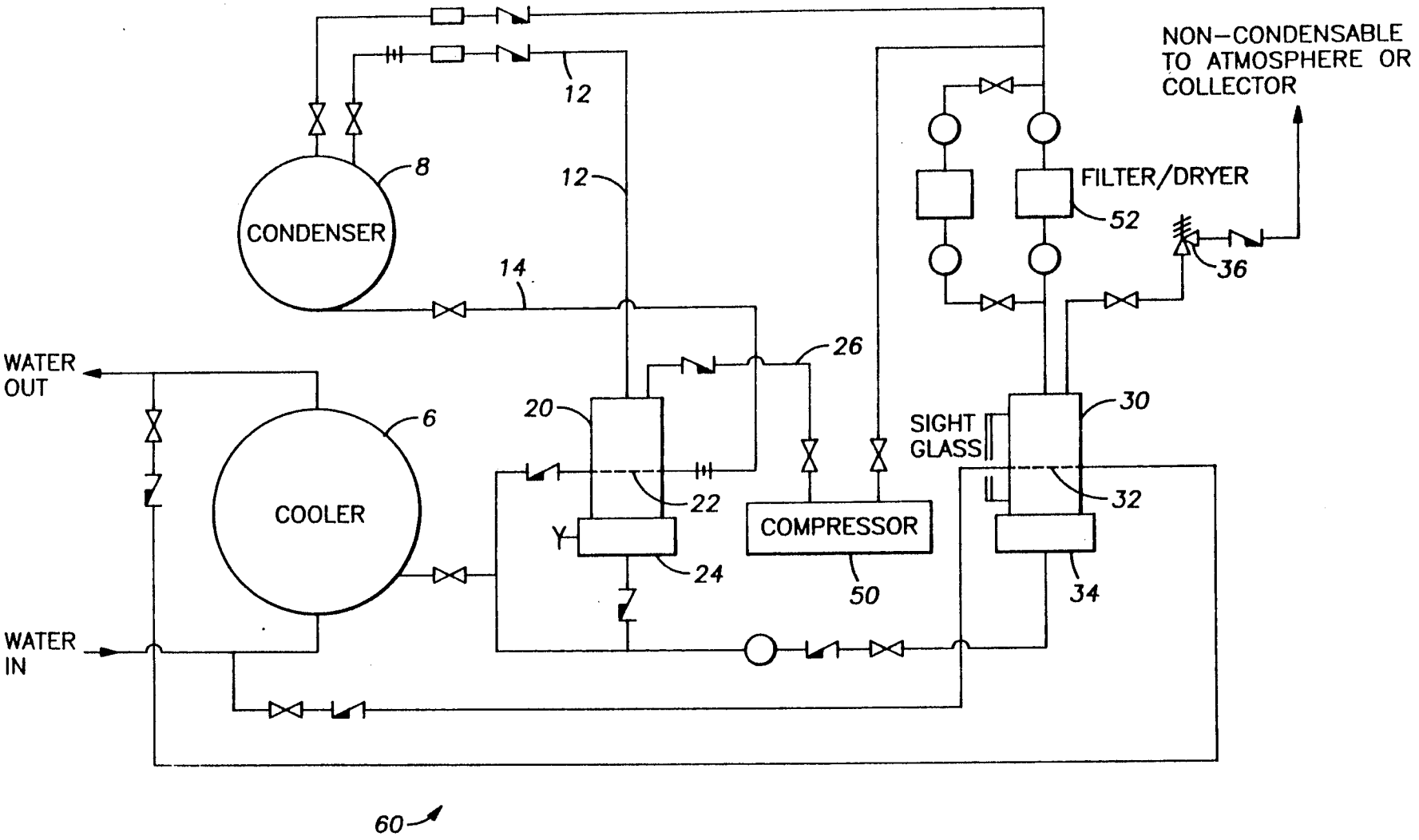
FIG. 1 shows a schematic view of a closed loop refrigerant recovery system according to the present invention.

FIG. 1 shows a closed loop refrigerator recovery system designated in general by numeral 10. The major components of the refrigerant recovery system 10 are primary purge condenser 20 and secondary purge condenser 30.

Non-condensible gas which collects in condenser 8 are removed from the condenser by the purge line 12. The purge line 12 conducts these gases containing some refrigerant vapors to primary condenser 20. Coolant line 14 conducts refrigerant to coil 22. Coil 22 temperature varies but is usually about 40° F. The coil condenses refrigerant or Freon vapors out of the gases vented from the condenser. When a level of refrigerant liquid has built up in the primary condenser, the float 24 lifts allowing liquid refrigerant to be returned back to the cooler 6.

Because of the variation of temperature of the coil 22 due to changing ambient temperature, all the refrigerant vapors vented from the condenser may not have been collected. The secondary purge line 26 conducts non-condensibles and any remaining vapors to a purge compressor. The purge compressor 50 sends these high pressure gases and vapors to secondary condenser 30. In one embodiment, the vapors are purged through a dryer or filter located between compressor 50 and condenser 30. Purge compressor 50 runs on an intermittent basis. When pressure in the primary purge condenser 20 is approximately 2 psig less than the pressure in the condenser 8, purge compressor 50 is started and runs until the primary purge condenser is approximately 4 psig less than condenser 8.

Coils 32 in the secondary condenser are cooled by a reciprocating chiller 60. The reciprocating chiller is an independent refrigeration unit. In an alternate embodiment, brine from cooler 6 may be used to cool coil 32.

When sufficient liquid has collected in secondary condenser 30, the float 34 lifts allowing the liquid refrigerant to be returned to the cooler 6.

Coil temperature in the secondary condenser is maintained at 18° to 25° F. Relief valve 36 is set to lift at 22 lbs. pressure. Valve 36 acts in cooperation with the low temperature maintained by the secondary coil to assure that the relief valve only lifts when non-condensibles are present. The temperature is maintained low enough so that for pressure to increase to this point, it would have to be due to non-condensible gas since all refrigerant vapor will have been reduced to a liquid at this temperature. The non-condensibles are conducted to the collector facility 38 or vented to atmosphere.

I claim:

1. A closed loop refrigerant recover system for removing non-condensible gases from an air conditioning system comprising:

a primary purge condenser for receiving refrigerant vapors and non-condensible gases from said air conditioning system;

a purge compressor for compressing refrigerant vapors and non-condensible gases from said primary purge condenser;

a secondary purge condenser for receiving refrigerant vapors and non-condensible gases from said purge compressor; and a relief valve connected to said secondary purge condenser.

2. A closed loop recovery system as in claim 1 wherein the temperature of said secondary condenser is maintained at 18° to 25° F.

3. A closed loop recovery system as in claim 1 wherein said relief valve is set out at approximately 22 lbs.

4. A closed loop recovery system as in claim 1 wherein a chiller provides a cooling fluid to said secondary purge condenser.

5. A closed loop recovery system as in claim 1 wherein a dryer, between said purge compressor and secondary purge condenser, removes moisture.

6. A closed loop refrigerant recovery system as in claim 1 wherein a starting means starts said purge compressor when said primary purge condenser is approximately 2 psig less than the pressure in a main condenser in said air conditioning system and stops said purge compressor when the pressure in said purge condenser is approximately 4 psig less than the pressure in said main condenser.

* * * * *